United States Patent [19]

Adams

[11] Patent Number: 4,699,290

[45] Date of Patent: Oct. 13, 1987

[54] SANITARY TAMPERPROOF DOUBLE CLOSURE CONTAINER END CAP

[76] Inventor: Jay J. Adams, 133 Scott Rd., Pittsburgh, Pa. 15239

[21] Appl. No.: 875,718

[22] Filed: Jun. 18, 1986

[51] Int. Cl.[4] ..... B65D 51/22

[52] U.S. Cl. ..... 220/258; 220/254; 220/67; 206/508

[58] Field of Search ..... 220/258, 270, 254, 67; 222/541; 206/508

[56] References Cited

U.S. PATENT DOCUMENTS 3,434,620 3/1969 Laurizio ..... 220/258

4,361,250 11/1982 Foster ..... 220/254

*Primary Examiner*—George T. Hall

*Attorney, Agent, or Firm*—Parmelee, Miller, Welsh & Kratz

[57] ABSTRACT

A foolproof sanitary pour type of end cap is provided for a container or can that may be used for providing and dispensing powdered or granular items, such as foods, vitamin and medicine capsules or liquids, such as carbonated soft drinks. The cap body provides an initial completely hermetically sealed cover for the container after the goods have been placed therein for shipment, storage and sale. The sealed relation is such that the inside of the container and its contents cannot be exposed without tearing-off a membrane closure portion across a centrally disposed, inset pouring spout or collar. When the contents are to be first used, a swingable closure lid is opened and the membrane is removed by a pull tab. However, the remaining contents can be then closed-off by the swingable lid which has means for maintaining the contents in a sealed-off relation from the ambient atmosphere and has latching means for flexibly retaining it in closed position until an additional quantity of the contents is to be used.

6 Claims, 7 Drawing Figures

SANITARY TAMPERPROOF DOUBLE CLOSURE CONTAINER END CAP

This invention relates to a new sealing-off end closure cap for a can or container that has a somewhat universal application irrespective of the nature of its contents, whether a carbonated pressurized liquid or a granulated or powdered solid material that is to be dispensed. However, it is especially suitable for providing a substantially hermetically sealed container for use in dispensing solid food and medical items.

It has been devised to meet a problem in the art which has existed for many years and as related to screw caps and to metal lid pull tabs. In the first instance, to provide a tamperproof seal, it has been necessary to use some form of plastic sealing cover which has to be cut and torn-off before the cap can be unscrewed. Thereafter, the cap has to be screwed-down tightly after each removal of a portion of the contents and has to be unscrewed when an additional portion is needed. On the other hand, pull tabs such as presently used for soft drink cans are difficult to initially grip and open, and when opened, leave any unused portion of the contents exposed, subject to spillage and spoilage.

I previously developed a bellows-like spout type of construction for dispensing carbonated drinks and the like and which is set forth in my U.S. Pat. No. 4,560,081 of Dec. 24, 1985. In this construction, a bellows-like lid spout is mounted for expansion when a closure lid is opened. This eliminates the need for a fingernail-breaking pull tab construction and provides a convenient and sanitary means for intermediate drinking of the liquid contents. Also, since the lid is constructed to close-off the pour opening, the liquid contents can be stored for subsequent useage.

There has, however, been a need for a type of lid which will be especially suitable for dispensing powdered or granular goods, such as foods and other edible materials which should be protected from tampering or substitution of poisonous material. In this respect, the need is for a lid that will have a hermetic seal and one that cannot be opened without spoiling the seal and thus alerting the prospective purchaser that there may have been tampering with its original contents.

The present invention thus deals with a type of end cap that will be tamperproof, and at the same time, will enable a subsequent periodic dispensing of its contents which contents will be protected in the interim by a hinged sealing-off lid.

It has been an object of the invention to devise an inexpensive and practical end cap for a storage and dispensing container that will be substantially tamperproof as to its initial contents, that has an easily gripped initial tear tab and an initial tear-out hermetic sealing-off wall or membrane, and that will, after being first opened, enable retaining any contents in a substantially sealed-off relation during interim storage.

Another object has been to develop a unitary type of end cap that will be initially tamperproof and, at the same time, that will enable a pour-dispensing of its contents from an opening that is protected by a sealing-off closure lid.

A still further object of the invention has been to provide an end cap unit for a dispensing container which will inherently provide a fully sealed-off tamperproof protection of its contents, which will enable an easy and practical initial breaking of its seal and dispensing of its contents, and which will further enable the contents to be displaceably sealed-off, so that they may be quickly and easily opened and closed-off and dispensed from time to time and kept in a fresh, useable condition.

These and other objects of the invention will appear to those skilled in the art from the description of the disclosed embodiment, the drawings and claims herein set forth.

Figure 3:
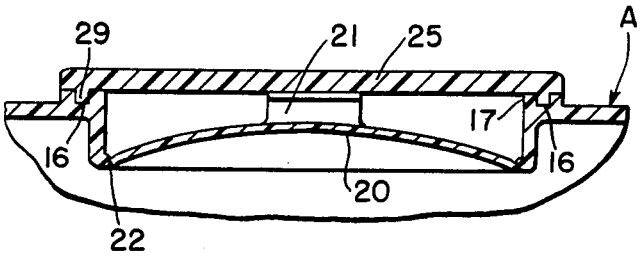
FIG. 3 is a fragmental section in elevation on the scale of FIG. 2 and taken along line III of FIG. 1 at 90° with respect to FIG. 2.
Figure 2:
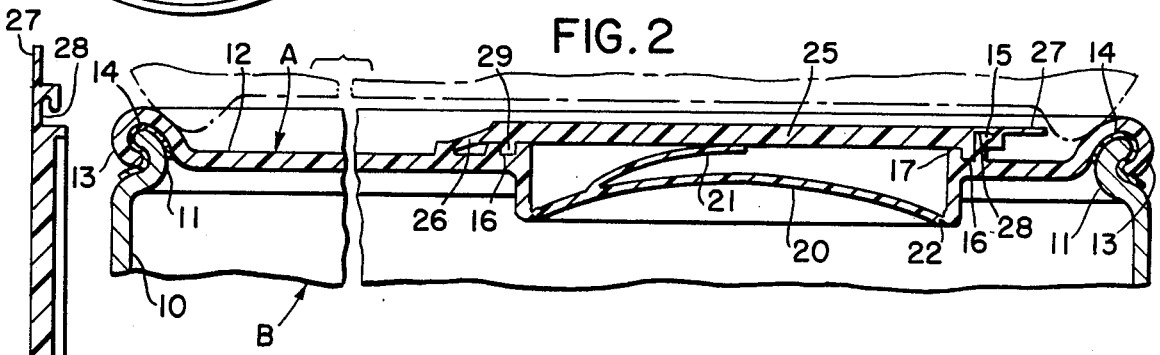
FIG. 2 is an enlarged cross-section taken along the line II—II of FIG. 1 illustrating how a pair of containers of the invention may be endwise stacked; in the figure, an end closure cap of the invention is shown in its initial, hermetically sealing-off mounted relation over the open mouth of a can or container.
Figure 4:
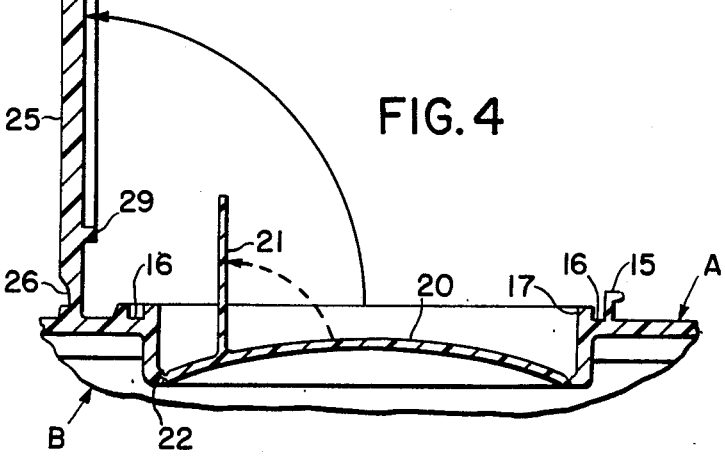
FIG. 4 is a fragmental side section in elevation of the construction of FIGS. 2 and 3 showing its swingable lid in a released, upwardly extending, flexed relation and also showing a pull tab of its tear-out sealing wall in an upward, ready position, as released from its downwardly flexed positioning shown in FIGS. 2 and 3.
Figure 6:
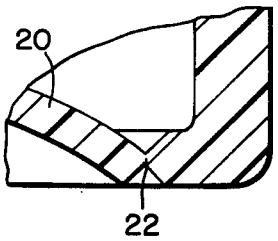

And, FIG. 6 is a greatly enlarged corner fragment of the construction of FIGS. 2, 3 and 4 showing the reduced thickness, connecting tear-out, annular rim portion of the sealing-off wall or membrane for the pour opening of the pouring collar of the construction.

DESCRIPTION OF THE EMBODIMENT DISCLOSED

Figure 2A:
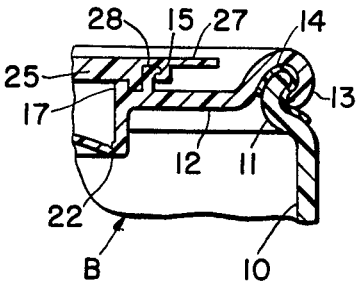
FIG. 2A is a fragmental section on the scale of FIG. 2, particularly illustrating the lapped-over, sealed-off mounting of lip edges of the end cap of FIG. 2 with lip edges of the container and in such a manner as to keep the edges of the lid within an annular plane of extension of the wall of the container.

An end cap or closure A having a body of a suitable relatively inexpensive, easily, unitarily molded material, such as a plastic resin having suitable characteristics of resiliency, elasticity and tensile strength is the preferable medium of the construction. End cap A serves as a closing body for the open end of a can or container B and is adapted to be mounted, as shown in the drawings, in a turned or crimped-over, hermetically sealed-off relation with respect to an open end portion of the container B. As indicated in FIG. 2A, a fluid-pressure-proof, intermediate sealing layer of latex 14 may be applied between an outer peripheral, turned-over edge or rim portion 13 of the cap A and a slightly inwardly offset, cooperating, and interlocking edge portion 11 of the container or can B. This serves to not only keep out outside ambient contamination, but to preclude an undiscoverable introduction of extraneous materials into the can as does the fact that the cap A is initially of a unitary, one-piece construction. It further provides a seal that, in the case of a pressurized fluid or liquid content, will withstand a pressure build-up of a maximum of about 140 psi. This is well above the minimum industrial requirement of 90 psi for carbonated soft drink containers. The extra factor of safety is advantageous, since fluid pressure tends to build-up when carbonated drinks are shaken-up in handling and shipping. Even when powdered, or granular canned goods, etc. are involved, a slightly positive fluid pressure can be used to further preclude entry of outside contaminants. That is, it may be desirable to provide an inert gas content under a slight positive pressure when the goods are being stored over a long period of time.

Figure 5:
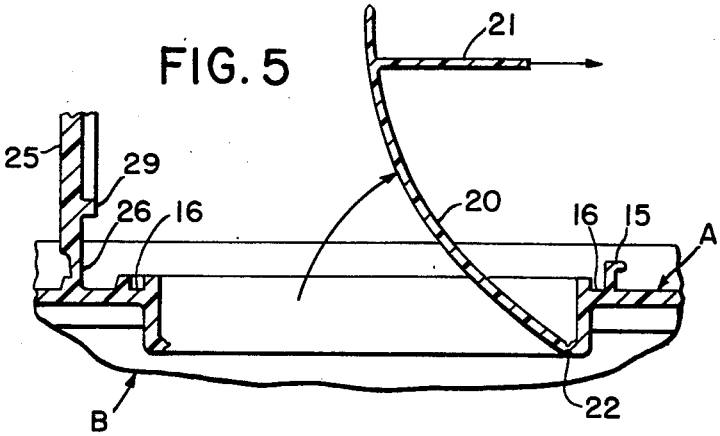
FIG. 5 is a fragmental section on the scale of and of the structure of FIG. 4 showing the tear-out sealing wall in the process of being removed from within a pouring collar, and preliminarily to an initial useage of the contents of the container; this represents the initial pulling-out of the tamperproof sealing-off wall portion of the construction prior to initial useage of the contents of the container.

As noted from the above discussion, the container cap construction of the invention is devised to enable a universal type of application for the needs of different materials and, at the same time, to provide an easily removable type of initial opening or exposure of its contents. A normally upwardly biased, projecting pull tab 21 is shown extending from a centrally disposed, cross-extending, tear-wall type of end closure wall or membrane 20. The wall 20 extends across inner annular edges of a pour collar 17 that projects slightly inwardly from and in a perpendicular relation with respect to a cross-extending, substantially planar, outer, peripheral mounting and closing end wall portion 12 (see FIG. 2). The tear-out wall or membrane 20 is secured in a hermetically sealed relation around its outer periphery by a tear rim portion 22 of a reduced thickness. As shown in FIG. 4, the tear-out wall 20 provides a tamperproof, hermetic seal for the contents of container B unitl it is initially removed by a consumer gripping and pulling the tab 21 upwardly and in a right hand angular relation, as indicated by the arrow of FIG. 5. A swing lid 25 (see FIG. 3) is adapted to initially enclose the pull tab 21 within spacing within the collar 17 that is defined by the lid and the tear-out wall portion 20 (see FIGS. 2 and 3).

After the user has torn-out the wall or membrane 20 which is shown of an upwardly convex and inwardly concave shape, a desired quantity of the product involved may then be poured-out of the container B. After this, swing-over closure lid 25 may be used to provide an auxiliary or a secondary seal for the remaining contents.

Comparing FIGS. 2, 4 and 5, it will be seen that lid 25 has an annular, projecting sealing rim or tongue portion 29 that is adapted to resiliently engage within a complementary sealing groove portion 16 of the wall 12 when the lid is in its closing-off, downwardly flexed position. Such a full, supplemental closing and sealing-off relation is maintained by cooperating latching portions 15 and 28 (see FIG. 2A) respectively of the wall 12 and of the lid 25. Thus, the lid 25 has a primary function of providing a quick, uncomplicated and easy entry and closing-off of the pour opening defined by the collar 17 after the initial seal represented by the tear-out wall 25 facilitates its release from a sealing, latched, closing-off "down" position. During storage and shipment, the lid 25 will be in its "down" or closing position and thus, will serve to keep the pour collar 17 and the tear-out wall 20 clean and sanitary.

The lid 25, the end wall 12 and the collar 17 may be of a heavier thickness than the tear-out wall 20 and its pull tab 21. The lid 25 is preferably outwardly biased or has an as-formed memory such that, when released from its latched relation, it will swing about its hinge portion 26 to an outwardly open position that may be substantially normal to the end wall portion 12. This is also preferable as to the pull tab 21. Its hinge or swing portion 26 is shown of a slightly lesser thickness.

The tear-out wall portion 20 is connected by annular tear-off rim portion 22 of minimum thickness consistent with a maximum fluid pressure to which the container B is to be subjected. I contemplate the use of cross ribbing on at least one face (not shown) of pull tab 21 and of lift tab 27 for the lid 25. I also contemplate mounting the cap A within an opening provided in an end lid of a container or can rather than about its outer edge portion 11. In such a case, the end wall 12 may be provided with a edge groove such as 16, about its outer periphery which will tightly fit over and receive an inner peripheral open edge portion of the container end lid therein. A hermetic seal will be provided by the use of a latex layer therebetween, similar to 14 of FIG. 2.

Figure 1:
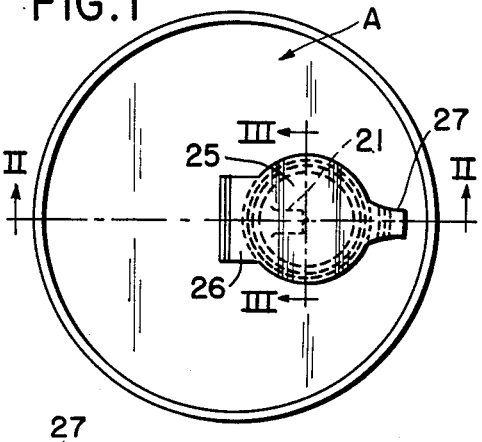
FIG. 1 is a top plan view of an end cap constructed in accordance with the invention.

As shown in FIG. 2, the container or can B has mounting such that both its lip edge 11 and the overlapping lip edge or rim 13 of the end cap lie behind an annular plane of extension of the side wall 10 of the container. As a result, a group of containers B can be sidewise closely stacked for storage and shipment. Also, as shown, the raised relation of the rim 13 and the inwardly sloped rim of the bottom of the container (see the dot and dash lines of FIG. 2), enable the containers to be stacked endwise in an aligned relation. This is somewhat similar to the type of construction shown in my earlier mentioned patent. However, in the present instance, it will be noted from FIG. 2 that the upward extension of a circumferential shoulder defined by the crimped-over shape of cooperating lip or outer edge or rim portions 11 and 13 is such that it extends upwardly in a fully spaced relation above a horizontal plane of end closure A as well as the lid 25 when the lid is in its closed position; also, a thin layer of sealing latex 14 (see FIGS. 2 and 2A) is shown applied between the container edge 11 and the latched-over, annular lip or rim portion 13 of the end cap A. This provides a further assurance of a hermetic, pressure-sealing off of the contents. It will be noted (see the dot and dash lines of FIG. 2) in vertically stacking an upper can on a lower can, that outer, lapped-over joint or shoulder defined by 11 and 13 of the lower can cooperates with and inwardly receives a convexly downwardly extending shoulder that is radially inwardly sloped about the bottom rim of the upper can or container. The bottom of the upper can is indicated as shaped to rest in a supported, radially inwardly positioned relation on the lower can, in such a manner that the upper can is vertically aligned and retained in a stacked relation on the lower can and, with its bottom end wall in a fully spaced relation above the end closure or cap A and the lid 25 of the lower can. Although, for the purpose of illustration, I have shown a somewhat circular-shaped pour-opening-defining collar 17 (see FIG. 1), it will be apparent that any suitable shape may be used.

The provision of the shown spaced relation between the bottom end wall of an upper can or container, the end closure A and the lid 25 and its assembly of a lower can or container, is important in preventing any damage to the plastic end walls and the lid assembly. It will be noted that the combined weights of a vertically stacked series of cans will be substantially fully concentrated along their vertical walls rather than upon their end walls. An unlimited heighth of aligned stacking of cans is thus enabled without any danger of damage to or spoiling of the hermetic seals of their lid end assemblies.

This is particularly important when the contents of the cans or containers involved may be under a pressure of 90 psi and subject to a build-up of pressure to about 140 psi, as during truck or train shipment. Referring to FIG. 2A, it will be noted that the outer peripheral rim 13 of the end cap or closure A is shown as curved upwardly and outwardly over and inwardly into the upper, peripheral edge portion 11 of the container. Also, the peripheral edge portion 11 is shown as curved upwardly, inwardly and outwardly within and with respect to the rim edge portion 13 to thus provide an upper interlocking shoulder within and on which the bottom rim of an upper can is supported. As shown in FIG. 2, such shoulder thus serves as an aligning, centering, positioning support for an outer side of a convex, downwardly, inwardly sloped shoulder of the bottom rim of the upper can to accurately align a pair of stacked cans with respect to each other.

The invention particularly deals with a unitary end cap body of plastic resin construction which may be mold-formed in one operation to provide a complete construction. In this connection, as previously indicated, the pull tab 21 as well as the lid 25 are to be preferably formed with a memory or outward bias that insures a normal, upwardly extending tensioning, such that when releases from a downwardly positioning, they will automatically return in a resilient or elastic manner to an "up" positioning. Also, as previously pointed out, the construction is preferably of plastic resin material and one which has necessary characteristics of tensile strength under fluid pressure as well as of a suitable resiliency or elasticity. In this connection, I have used as an optimum polypropylene and next in preference a polyethylene of the polyolefin generic classification.

I claim:

1. An improved container of the character shown and described for powdered or granular goods, fluids and the like whose contents may be under a positive fluid pressure which comprises, a foolproof sanitary pour type of end closure for the container, said end closure having a substantially planar body adapted to extend across and close-off an upper open dispensing end of the container in a fully secure sealing-off relation thereon, a radially inwardly positioned pouring collar extending from and within a central area of said end closure, a lid swingably mounted on said end closure for movement between a downward closing-off position over said collar and an upwardly open position with respect thereto, a sealing-off wall having a pull tab and a tear-off rim edge integrally connected about said collar to freely close-off said lid and an open pouring area defined by said collar with respect to contents of the container, latching means between said end closure and said lid for releasably retaining said lid in its downward closing-off position over said collar, an upwardly extending shoulder defined about the outer extent of said end closure that consists of a rim of said end closure and an upper edge portion of the side wall of the container that are in a crimped-in interlocked relation with each other, said shoulder extending above an upper horizontal extent of said end closure and said lid, said container at its lower end having a convexly downwardly-inwardly extending shoulder about its outer extent that is shaped to rest in a supported radially inwardly positioned relation on the defined shoulder of a lower positioned can of the defined construction in such a manner as to support an upper container of the defined construction in a vertically aligned securely retained stacked relation on a lower can of the defined construction and essentially to retain the bottom end of the upper container in a fully upwardly spaced-apart relation with respect to said end enclosure and lid of the lower can.

2. An improved container as defined in claim 1 wherein a sealing latex is interposed between said rim of said end closure and said upper edge portion of the side wall.

3. An improved container as defined in claim 1 wherein, said rim of said end closure is turned upwardly-over and downwardly into said upper edge portion of the side wall of the container, and said upper edge portion is curved upwardly and outwardly within said rim.

4. An improved container as defined in claim 3 wherein a sealing-off resin is interposed between crimped-in interlocked portions of said rim and said end closure.

5. An improved container as defined in claim 16 wherein said end closure, said lid and said collar are of a polyolefin resin material.

6. An improved container as defined in claim 1 or 2 wherein, said end closure, said collar and said lid are of a relatively heavy thickness of plastic material, said sealing-off wall is a plastic membrane of a lesser thickness than said end enclosure, collar and lid, said upper shoulder is radially inwardly offset to keep it within an annular plane of the outer side wall of the container, said latching means is also of plastic material, and said lid is mounted on said end closure by a plastic hinge of lesser thickness than said lid.

* * * * *